US011705674B2

(12) United States Patent
Pu et al.

(10) Patent No.: US 11,705,674 B2
(45) Date of Patent: Jul. 18, 2023

(54) CONNECTOR HAVING SHIELDING STRUCTURE WITH SHIELDED AND SHIELD COVER

(71) Applicant: LUXSHARE PRECISION INDUSTRY CO., LTD., Shenzhen (CN)

(72) Inventors: Yingbin Pu, Shenzhen (CN); Lei He, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 86 days.

(21) Appl. No.: 17/474,575

(22) Filed: Sep. 14, 2021

(65) Prior Publication Data

US 2022/0407267 A1 Dec. 22, 2022

(30) Foreign Application Priority Data

Jun. 18, 2021 (CN) ..... 202121372344.7

(51) Int. Cl.
*H01R 13/6581* (2011.01)

(52) U.S. Cl.
CPC ..... *H01R 13/6581* (2013.01)

(58) Field of Classification Search
CPC ..... H01R 13/6581
USPC ..... 439/607.56
See application file for complete search history.

(56) References Cited

U.S. PATENT DOCUMENTS 6,039,606 A * 3/2000 Chiou ..... H01R 13/506 439/607.45
7,134,900 B2 * 11/2006 Chung ..... H01R 13/6583 439/353
7,255,607 B1 * 8/2007 Wu ..... H01R 27/00 439/660
7,267,579 B1 * 9/2007 Wu ..... H01R 13/6593 439/607.41
7,410,366 B2 * 8/2008 Wu ..... H01R 13/2442 439/660
7,625,236 B1 * 12/2009 Wu ..... H01R 24/62 439/607.58
7,628,638 B2 * 12/2009 Wu ..... H01R 13/6582 439/353

(Continued)

*Primary Examiner* — Peter G Leigh
(74) *Attorney, Agent, or Firm* — Birch, Stewart, Kolasch & Birch, LLP

(57) ABSTRACT

Provided are a metal housing and a connector. The metal housing is configured to accommodate an insulation body and the metal housing includes a first half housing on which a first overlapping portion is disposed and a second half housing on which a second overlapping portion is disposed. The first overlapping portion is overlapped with and connected to the second overlapping portion when the metal housing accommodates the insulation body. With the above-mentioned structure, the metal housing is not easily deformed when being pressed and struck by external forces. The connector includes an electrical connection part and an insulation body which accommodates the electrical connection part. The connector further includes the above-mentioned metal housing which accommodates the insulation body. As the above-mentioned metal housing is used for accommodating the insulation body and the electrical connection part, the connector has better capabilities of anti-press and anti-strike.

18 Claims, 5 Drawing Sheets

(56) References Cited

U.S. PATENT DOCUMENTS

| | | | | |
|---|---|---|---|---|
| 7,708,600 | B2 * | 5/2010 | Wu | H01R 27/00 439/660 |
| 7,736,186 | B2 * | 6/2010 | Li | H01R 13/6593 439/607.58 |
| 8,011,960 | B2 * | 9/2011 | Xiao | H01R 13/6583 439/607.56 |
| 8,100,709 | B2 * | 1/2012 | Zhang | H01R 13/6583 439/353 |
| 8,142,226 | B2 * | 3/2012 | Xiao | H01R 27/02 439/607.56 |
| 8,668,523 | B2 * | 3/2014 | Wu | H01R 13/5812 439/607.23 |
| 8,777,665 | B2 * | 7/2014 | Il | H01R 13/6593 439/660 |
| 8,870,596 | B2 * | 10/2014 | Ii | H01R 13/6581 439/607.41 |
| 8,926,368 | B2 * | 1/2015 | Il | H01R 13/658 439/607.5 |
| 9,059,543 | B2 * | 6/2015 | Wu | H01R 13/652 |
| 10,511,116 | B2 * | 12/2019 | Maesoba | H01R 13/4364 |
| 10,741,977 | B2 * | 8/2020 | Maesoba | H01R 13/502 |
| 2011/0124225 | A1 * | 5/2011 | Zhou | H01R 13/6593 439/607.01 |
| 2011/0281464 | A1 * | 11/2011 | Hou | H01R 13/6593 439/607.55 |

* cited by examiner

CONNECTOR HAVING SHIELDING STRUCTURE WITH SHIELDED AND SHIELD COVER

CROSS-REFERENCE TO RELATED APPLICATION(S)

This application claims priority to Chinese Patent Application No. 202121372344.7 filed Jun. 18, 2021, the disclosure of which is incorporated herein by reference in its entirety.

TECHNICAL FIELD

The present disclosure relates to the technical field of connectors and in particular to a metal housing and a connector.

BACKGROUND

A connector disposed at an end of a cable generally includes an electrical connection part which is composed of a plurality of conductive terminals and an electronic material and is used for docking of the cable and an object connector, an insulation body for accommodating the electrical connection part, and a metal housing for covering the outside of the insulation body. The functions of the metal housing are to provide a shielded environment for the electrical connection part and also to resist external forces such as external press and strike, so as to prevent the electrical connection part from being damaged and failing.

Typically, a metal housing is made of a metal sheet through processes of bending, stamping, and the like so as to enable opposite ends of the metal sheet to be connected to each other and fixed by U-shaped or dovetail-shaped riveting structures. Then, the metal sheet is formed into a cylindrical housing. Because a top wall and a bottom wall of an existing metal housing are both of flat structures, when the top wall and the bottom wall of the metal housing are subjected to large strike forces, the above-mentioned fixing structures are easily struck and easily fail, and meanwhile, the top wall and the bottom wall of the metal housing are deformed, which causes the damage and failure of the electrical connection part in the insulation body.

Therefore, it is necessary to provide a new metal housing and a new connector to solve the above-mentioned technical problem.

SUMMARY

One aspect of the present disclosure is to provide a metal housing which is not easily deformed when being pressed and struck by external forces.

To achieve this objective, the present disclosure adopts solutions described below.

A metal housing which is configured to accommodate an insulation body includes: a first half housing on which a first overlapping portion is disposed and a second half housing on which a second overlapping portion is disposed. The first overlapping portion is overlapped with and connected to the second overlapping portion when the metal housing accommodates the insulation body.

In an embodiment, the first overlapping portion includes a plurality of cantilevers, and the plurality of cantilevers are configured to be affixed on an inner wall or an outer wall of the second overlapping portion.

In an embodiment, the plurality of cantilevers are disposed at two ends on a docking side of the first half housing.

In an embodiment, the second overlapping portion includes a plurality of docking sheets, the plurality of docking sheets are in one-to-one correspondence with the plurality of cantilevers, and a rib is disposed between every two adjacent docking sheets.

In an embodiment, an end of the rib is flush with an end of each of the plurality of docking sheets in a direction facing away from the second half housing.

In an embodiment, each of the plurality of cantilevers is configured to be affixed on an outer wall of a respective one of the plurality of docking sheets, the rib is convexly disposed relative to the second half housing, and when the each of the plurality of cantilevers is overlapped with and connected to the respective one of the plurality of docking sheets, an outer wall of the each of the plurality of cantilevers is flush with an outer wall of the rib.

In an embodiment, one of the first overlapping portion or the second overlapping portion is provided with a hook, another of the first overlapping portion or the second overlapping portion is provided with an engaging hole, and the hook is hooked in the engaging hole when the first overlapping portion is overlapped with the second overlapping portion.

In an embodiment, the first half housing or the second half housing is further provided with a riveting claw.

Another aspect of the present disclosure is to provide a connector which has better capabilities of anti-press and anti-strike.

To achieve this objective, the present disclosure adopts solutions described below.

A connector includes an electrical connection part and an insulation body which accommodates the electrical connection part, and further includes the above-mentioned metal housing which accommodates the insulation body.

In an embodiment, one radial side of the insulation body is affixed to an inner wall of the first half housing, and another radial side of the insulation body is affixed to an inner wall of the second half housing.

The present disclosure has the beneficial effects described below.

The present disclosure provides the metal housing which is formed by docking and overlapping of the first half housing and the second half housing. That is, when the first half housing and the second half housing dock and cooperate with each other to accommodate the insulation body, the first overlapping portion and the second overlapping portion respectively disposed on the first half housing and the second half housing overlap and are connected to each other to increase the anti-press capability of the metal housing so that when the metal housing is pressed and struck by the external forces, the metal housing can be less or not deformed to effectively protect the electrical connection part in the insulation body.

The present disclosure provides the connector provided with the above-mentioned metal housing, which enables the connector to have better capabilities of anti-press and anti-strike and ensures that the connector can serve in an electrical connection usage scenario effectively for a long time.

REFERENCE LIST

Figure 1:
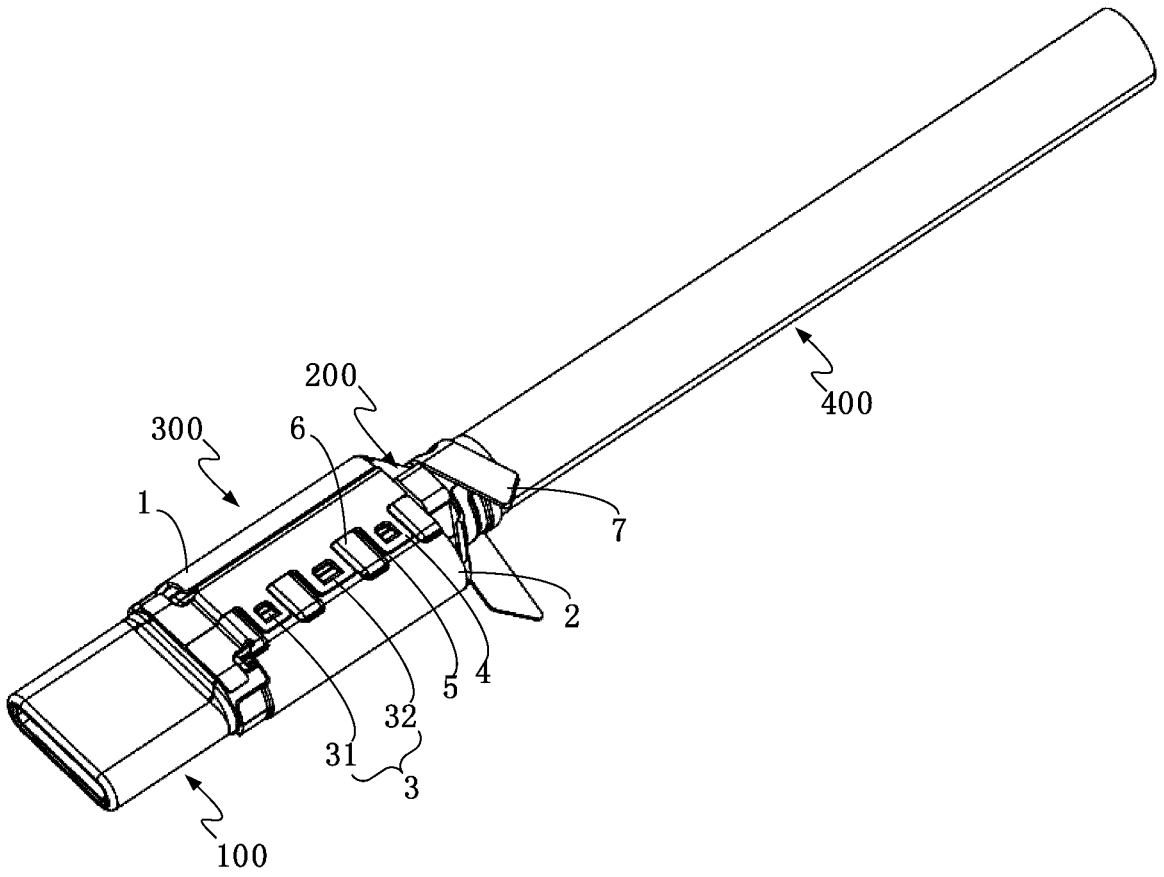
FIG. 1 is a structure view of a connector according to an embodiment of the present disclosure.

100 electrical connection part
200 insulation body
300 metal housing
400 cable
1 first half housing
2 second half housing
3 docking structure
31 hook
32 engaging hole
4 cantilever
5 docking sheet
6 rib
7 riveting claw

DETAILED DESCRIPTION

The present disclosure is further described below in detail in conjunction with drawings and embodiments. It is to be understood that the embodiments set forth below are intended to merely illustrate the present disclosure and not to limit the present disclosure. Additionally, it is also to be noted that for convenience of description, merely part, not all of the structures related to the present disclosure are illustrated in the drawings.

In the description of the present disclosure, unless otherwise expressly specified and limited, the term "connected to each other", "connected" or "fixed" is to be construed in a broad sense, for example, as fixedly connected, detachably connected, or integrated; mechanically connected or electrically connected; directly connected to each other or indirectly connected to each other via an intermediary; or internally connected between two components or an interactive relationship between two components. For those of ordinary skill in the art, specific meanings of the preceding terms in the present disclosure may be understood based on specific situations.

In the present disclosure, unless otherwise expressly specified and limited, when a first feature is described as "on" or "below" a second feature, the first feature and the second feature may be in direct contact or be in contact via another feature between the two features instead of being in direct contact. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below" or "underneath" the second feature, the first feature is right under, below or underneath the second feature, the first feature is obliquely under, below or underneath the second feature, or the first feature is simply at a lower level than the second feature.

In the description of the embodiment, the orientations or position relations indicated by terms such as "above", "below". "right" and the like are based on orientations or position relations shown in the drawings. These orientations or position relations are intended merely to facilitate and simplify description of the present disclosure, and not to indicate or imply that a device or element referred to must have such specific orientations or must be configured or operated in such specific orientations. Therefore, these orientations or position relations are not to be construed as limiting the present disclosure. In addition, the terms "first" and "second" are used merely to distinguish between descriptions and have no special meaning.

Figure 2:
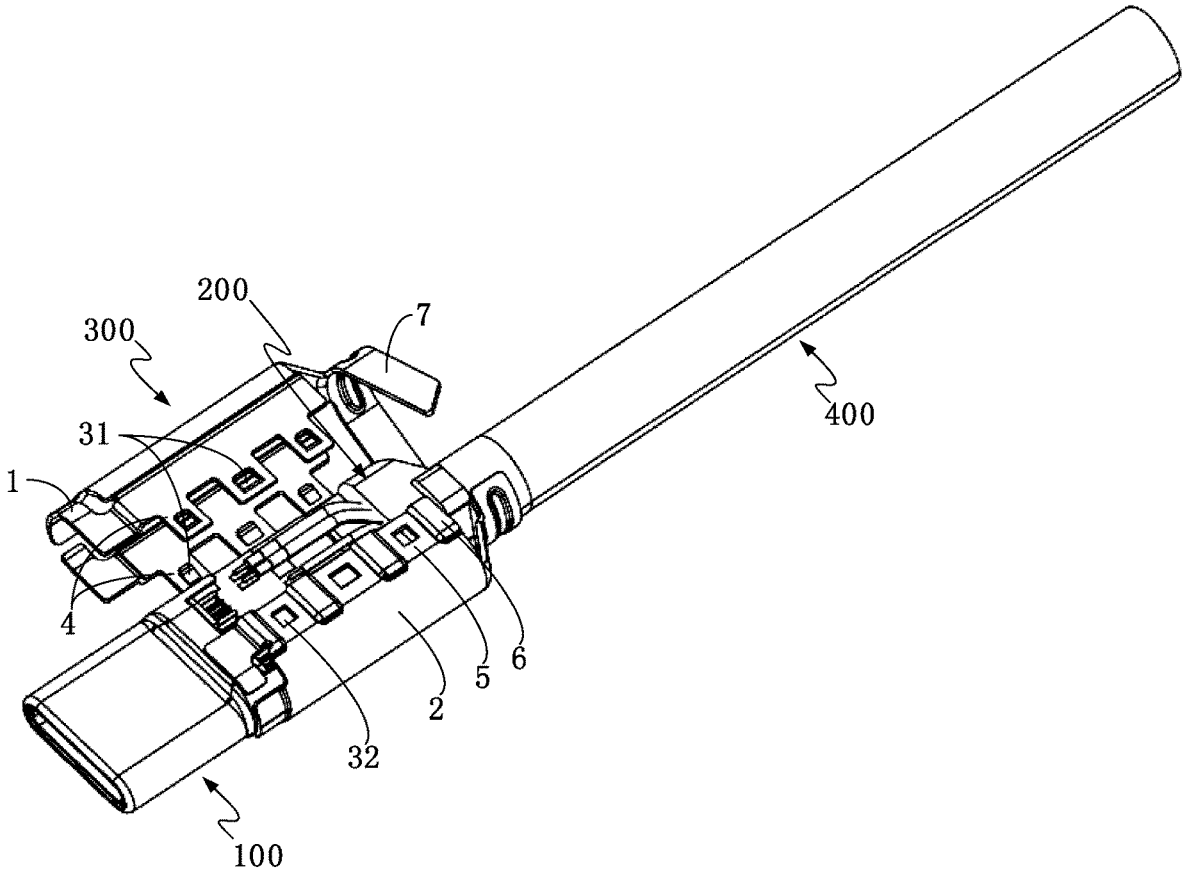
FIG. 2 is an exploded view of a connector according to an embodiment of the present disclosure.

As shown in FIGS. 1 and 2, this embodiment provides a connector. The connector includes an electrical connection part 100, an insulation body 200 which accommodates the electrical connection part 100, and a metal housing 300 which accommodates the insulation body 200. The electrical connection part 100 generally includes an electronic material, a plurality of conductive terminals which are exposed from the metal housing 300 and can be connected to an object connector and includes a cable 400 which extends backwards. The insulation body 200 is used for holding the electrical connection part 100 and insulating the electrical connection part 100 from the metal housing 300. The metal housing 300 can provide a shielded environment for the portion of the electrical connection part 100 located in the metal housing 300 and also has the function of resisting external forces such as external press and strike, so as to prevent the portion of the electrical connection part 100 located in the metal housing 300 from being damaged or failing.

Figure 3:
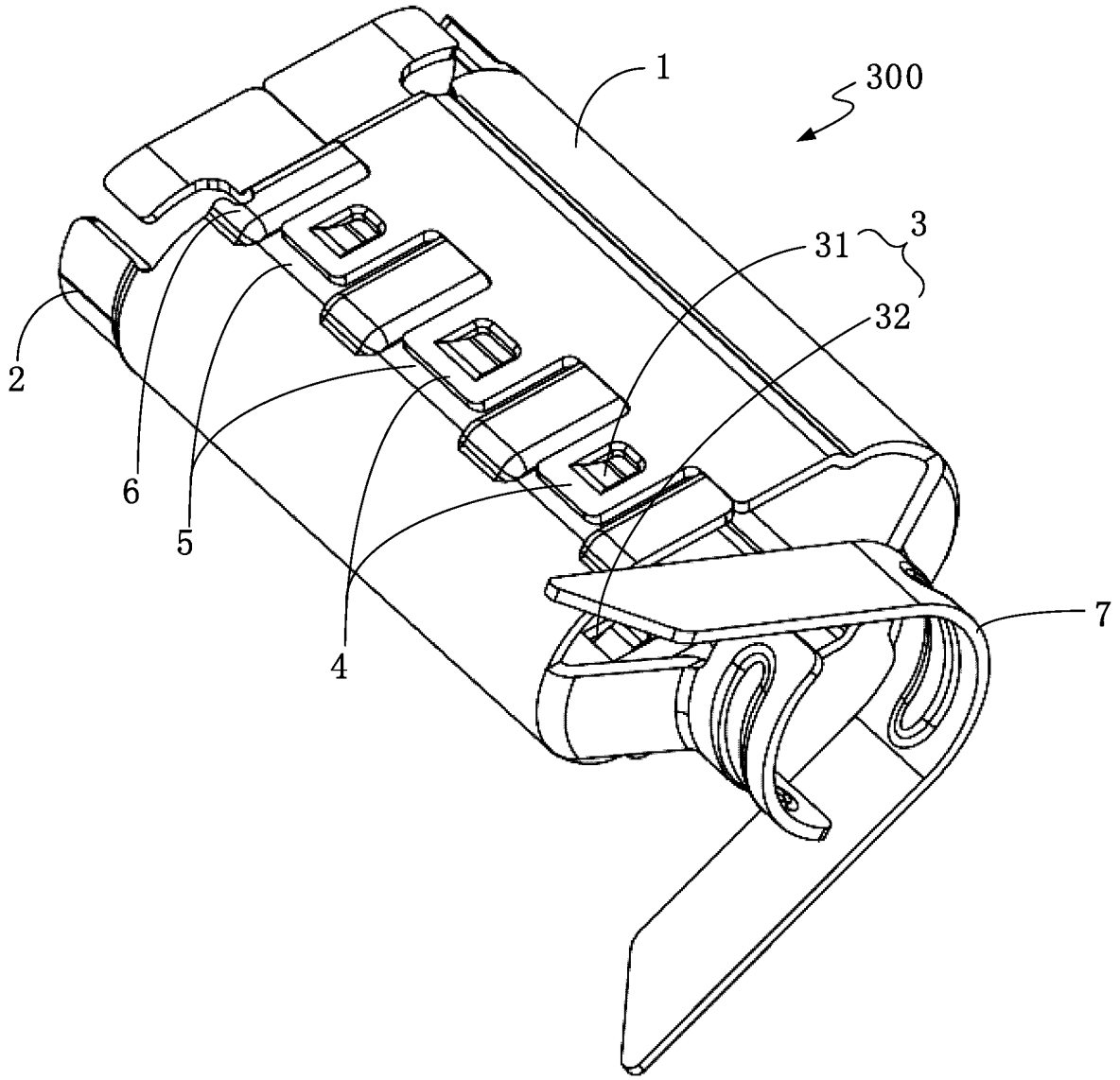
FIG. 3 is a structure view of a metal housing according to an embodiment of the present disclosure.
Figure 4:
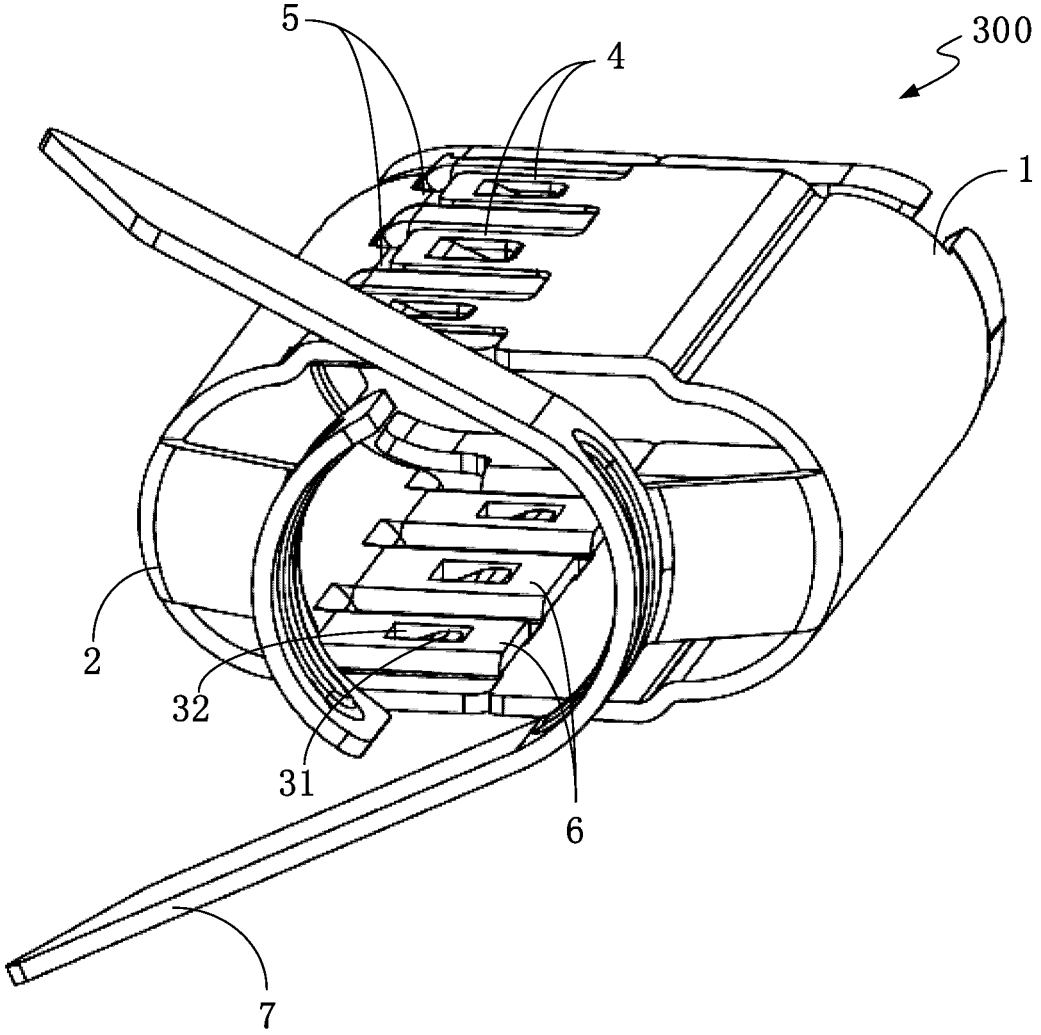
FIG. 4 is a structure view of a metal housing from another angle according to an embodiment of the present disclosure.

With continued reference to FIG. 2 and in conjunction with FIGS. 3 and 4, to increase the capabilities of anti-press and anti-strike of the metal housing 30), this embodiment further provides the metal housing 300 which includes a first half housing 1 and a second half housing 2. A first overlapping portion is disposed on the first half housing 1 and a second overlapping portion is disposed on the second half housing 2. When the first half housing 1 is docked with the second half housing 2, an accommodating cavity capable of accommodating the insulation body 200 is formed. Meanwhile, the first overlapping portion is overlapped with and connected to the second overlapping portion in a direction perpendicular to the axial direction of the metal housing 300. An overlapping region formed after the first overlapping portion is connected to the second overlapping portion can enhance the structural strength of the metal housing 300 in the above-mentioned overlapping region, thus meeting the requirement for increasing the capabilities of anti-press and anti-strike of the metal housing 300.

It is to be noted that, in this embodiment, a Universal Serial Bus (USB) type-c connector illustrated is used as an example. The first half housing 1 and the second half housing 2 have half-housing structures with U-like cross-sections, that is, the first half housing 1 and the second half housing 2 each have a middle curved portion and flat portions located on two sides of the curved portion. Generally, the structural strength of the curved portion is greater than the structural strength of the flat portion. Therefore, in this embodiment, the first overlapping portion and the second overlapping portion are disposed on the flat portion of the first half housing 1 and the flat portion of the second half housing 2, respectively, to enhance the structural strength of the metal housing 300 located on the above-mentioned flat portions.

However, in other embodiments, if the metal housing 300 mentioned above is applied to another form of connector and the connector has a structure different from the structure illustrated, a practitioner may dispose the first overlapping portion and the second overlapping portion mentioned above on a weak part of a metal housing 300 of the corresponding structure to enhance the overall structural strength of the metal housing 30) and the connector for increasing the capabilities of anti-press and anti-strike.

Figure 5:
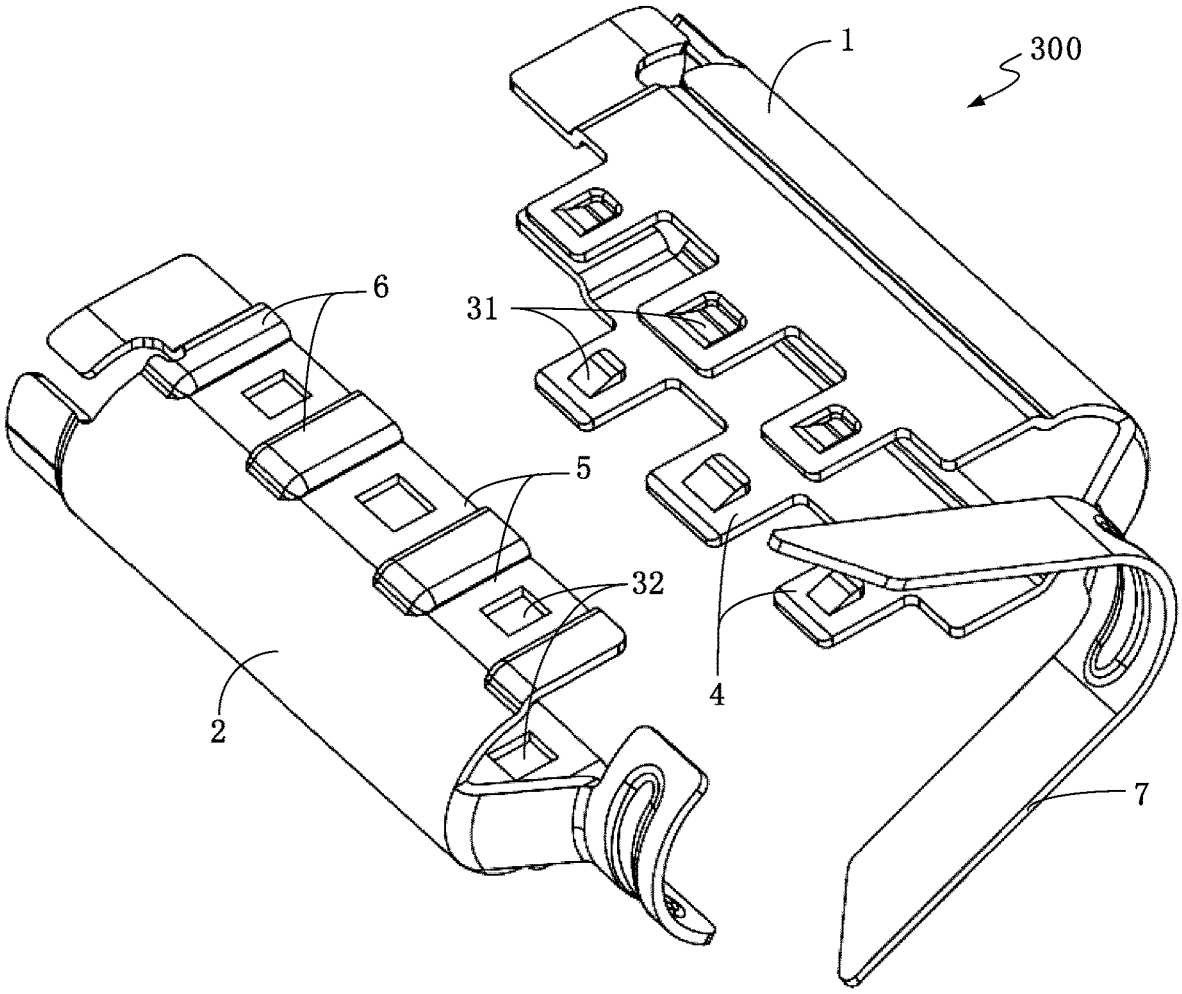
FIG. 5 is an exploded view of a metal housing according to an embodiment of the present disclosure.

As shown in FIG. 5, in this embodiment, the first overlapping portion includes a plurality of cantilevers 4. The plurality of cantilevers 4 are configured to be affixed on outer walls of a plurality of docking sheets 5 disposed on the second overlapping portion. The plurality of cantilevers 4 are overlapped with the plurality of connecting sheets 5 in one-to-one correspondence so as to enable the first overlapping portion to be overlapped with the second overlapping portion to obtain an overlapping region in the direction perpendicular to the axial direction of the metal housing 300.

In an embodiment, the plurality of cantilevers 4 are disposed at two ends on the docking side of the first half housing 1, that is, ends of the two flat portions of the first half housing 1. The plurality of docking sheets 5 are disposed at two ends on the docking side of the second half housing 2, that is, ends of the two flat portions of the second half housing 2. In this manner, the two ends on the docking side of the first half housing 1 are each affixed on the outer wall of the second overlapping portion so that the flat portions on both the front and back sides of the metal housing 300 are structurally reinforced.

In other embodiments, the cantilevers 4 may also be configured to be affixed on the inner walls of the docking sheets 5, that is, the two ends on the docking side of the first half housing 1 are each affixed on the inner wall of the second overlapping portion. This structure can also enable the flat portions on both the front and back sides of the metal housing 300 to be structurally reinforced.

In order to further enhance the structural strength of the metal housing 300, in this embodiment, the second half housing 2 is provided with a rib 6 at a position between every two adjacent docking sheets 5. The rib 6 may protrude outwardly from the two flat portions of the second half housing 2 or may be recessed inward from the two flat portions of the second half housing 2. In an embodiment, ends of the rib 6 are flush with ends of the docking sheet 5 in a direction facing away from the second half housing 2, that is, the rib 6 extends to an end face of the docking side of the second half housing 2 and the first half housing 1 so that the rib 6 has a larger size, thereby providing more anti-press and support capacities.

It is to be understood that when the metal housing 300 is pressed and struck by the external forces, the larger the area of the metal housing 300 in contact with the external object which applies the force to the metal housing 300 is, the smaller the pressure borne by the metal housing 300 is, and thus the metal housing 300 is more capable of avoiding being deformed under pressure. Therefore, in this embodiment, the cantilever 4 is configured to be affixed on the outer wall of the docking sheet 5, the rib 6 convexly disposed the second half housing 2, and the outer wall of the cantilever 4 is flush with the outer wall of the rib 6 when the cantilever 4 is overlapped with and connected to the connecting sheet 5. Thus, the cantilever 4 on the first half housing 1 and the rib 6 on the second half housing 2 can bear external pressure together so that the pressure borne by the metal housing 300 when the metal housing 300 is pressed is reduced.

As shown in FIG. 1, in this embodiment, when the first half housing 1 is docked with the second half housing 2, the first half housing 1 may be fixedly connected to the second half housing 2 by a riveting claw 7 which is disposed on one of the first half housing 1 and the second half housing 2 and is used for riveting a cable 400. The riveting claw 7 is merely arranged at one end of the metal housing 300 in general, so in order that the first half housing 1 and the second half housing 2 have a more stable connection structure, as shown in FIGS. 3 to 5, the first half housing 1 may be docked with and fixed to the second half housing 2 by a docking structure 3 disposed between the first half housing 1 and the second half housing 2. The docking structure 3 includes the hook 31 disposed on one of the first overlapping portion and the second overlapping portion and the engaging hole 32 disposed on the other of the first overlapping portion and the second overlapping portion. When the first overlapping portion is overlapped with the second overlapping portion, the hook 31 can be hooked in the engaging hole 32, thus enabling the first overlapping portion and the second overlapping portion to be connected into a whole instead of being disconnected.

The hook 31 and the engaging hole 32 may be disposed on the cantilever 4 and the docking piece 5, respectively. Alternatively, the hook 31 and the engaging hole 32 may be disposed on the docking piece 5 and the cantilever 4, respectively. The engaging hole 32 may be a through hole or a blind hole, which is not limited.

In addition, as shown in FIG. 2, in this embodiment, one radial side of the insulation body 200 may be affixed to an inner wall of the first half housing 1, and the other radial side of the insulation body 200 may be affixed to an inner wall of the second half housing 2 so that the first half housing 1 and the second half housing 2 can be supported from the inside of the metal housing 300 to further improve the capability of anti-press of the metal housing 300.

In this embodiment, the cantilevers 4, the hook 31, and the riveting claw 7 which are disposed on the first half housing 1 and the first half housing 1 may be integrally formed. The docking sheets 5, the ribs 6, and the engaging hole 32 which are disposed on the second half housing 2 and the second half housing 2 may also be integrally formed. In the existing art, the processing methods for die-cutting and bending a metal sheet or the like to obtain the first half housing 1 and the second half housing 2 are provided and will not be described here.

Apparently, the above embodiments of the present disclosure are merely example embodiments for clearly illustrating the present disclosure and are not intended to limit the implementations of the present disclosure. Those of ordinary skill in the art can make various apparent modifications, adaptations, and substitutions without departing from the scope of the present disclosure. Implementations of the present disclosure cannot be and do not need to be all exhausted herein. Any modification, equivalent, improvement, and the like made within the spirit and principle of the present disclosure shall be within the scope of the claims of the present disclosure.

What is claimed is:

1. A metal housing, the metal housing configured to accommodate an insulation body and comprising:

a first half housing, wherein a first overlapping portion is disposed on the first half housing; and a second half housing, wherein a second overlapping portion is disposed on the second half housing, and when the metal housing accommodates the insulation body, the first overlapping portion is overlapped with and connected to the second overlapping portion;

wherein the first overlapping portion comprises a plurality of cantilevers, and the plurality of cantilevers are configured to be affixed on an inner wall or an outer wall of the second overlapping portion;

wherein the second overlapping portion comprises a plurality of docking sheets, the plurality of docking sheets are in one-to-one correspondence with the plurality of cantilevers, and a rib is disposed between every two adjacent docking sheets;

wherein an end of the rib is flush with an end of each of the plurality of docking sheets in a direction facing away from the second half housing.

2. The metal housing according to claim 1, wherein the plurality of cantilevers are disposed at two ends on a docking side of the first half housing.

3. The metal housing according to claim 1, wherein one of the first overlapping portion or the second overlapping portion is provided with a hook, another of the first overlapping portion or the second overlapping portion is provided with an engaging hole, and the hook is hooked in the engaging hole when the first overlapping portion is overlapped with the second overlapping portion.

4. The metal housing according to claim 1, wherein the first half housing or the second half housing is further provided with a riveting claw.

5. A connector, comprising an electrical connection part and an insulation body for accommodating the electrical connection part, wherein the connector further comprises a metal housing of claim 1, and the insulation body is accommodated in the metal housing, wherein the first overlapping portion comprises a plurality of cantilevers, and the plurality of cantilevers are configured to be affixed on an inner wall or an outer wall of the second overlapping portion;

wherein the second overlapping portion comprises a plurality of docking sheets, the plurality of docking sheets are in one-to-one correspondence with the plurality of cantilevers, and a rib is disposed between every two adjacent docking sheets;

wherein each of the plurality of cantilevers is configured to be affixed on an outer wall of a respective one of the plurality of docking sheets, the rib is convexly disposed relative to the second half housing, and when each of the plurality of cantilevers is overlapped with and connected to the respective one of the plurality of docking sheets, an outer wall of each of the plurality of cantilevers is flush with an outer wall of the rib.

6. The connector according to claim 5, wherein one radial side of the insulation body is affixed to an inner wall of the first half housing, and another radial side of the insulation body is affixed to an inner wall of the second half housing.

7. The connector according to claim 5, wherein the plurality of cantilevers are disposed at two ends on a docking side of the first half housing.

8. The connector according to claim 5, wherein one of the first overlapping portion or the second overlapping portion is provided with a hook, another of the first overlapping portion or the second overlapping portion is provided with an engaging hole, and the hook is hooked in the engaging hole when the first overlapping portion is overlapped with the second overlapping portion.

9. The connector according to claim 5, wherein the first half housing or the second half housing is further provided with a riveting claw.

10. A connector, comprising an electrical connection part and an insulation body for accommodating the electrical connection part, wherein the connector further comprises a metal housing, and the insulation body is accommodated in the metal housing, wherein the metal housing comprises:

a first half housing, wherein a first overlapping portion is disposed on the first half housing; and a second half housing, wherein a second overlapping portion is disposed on the second half housing, and when the metal housing accommodates the insulation body, the first overlapping portion is overlapped with and connected to the second overlapping portion;

wherein the first overlapping portion comprises a plurality of cantilevers, and the plurality of cantilevers are configured to be affixed on an inner wall or an outer wall of the second overlapping portion;

wherein the second overlapping portion comprises a plurality of docking sheets, the plurality of docking sheets are in one-to-one correspondence with the plurality of cantilevers, and a rib is disposed between every two adjacent docking sheets;

wherein an end of the rib is flush with an end of each of the plurality of docking sheets in a direction facing away from the second half housing.

11. The connector according to claim 10, wherein one radial side of the insulation body is affixed to an inner wall of the first half housing, and another radial side of the insulation body is affixed to an inner wall of the second half housing.

12. The connector according to claim 10, wherein the plurality of cantilevers are disposed at two ends on a docking side of the first half housing.

13. The connector according to claim 10, wherein one of the first overlapping portion or the second overlapping portion is provided with a hook, another of the first overlapping portion or the second overlapping portion is provided with an engaging hole, and the hook is hooked in the engaging hole when the first overlapping portion is overlapped with the second overlapping portion.

14. The connector according to claim 10, wherein the first half housing or the second half housing is further provided with a riveting claw.

15. A metal housing, the metal housing configured to accommodate an insulation body and comprising:

a first half housing, wherein a first overlapping portion is disposed on the first half housing; and a second half housing, wherein a second overlapping portion is disposed on the second half housing, and when the metal housing accommodates the insulation body, the first overlapping portion is overlapped with and connected to the second overlapping portion;

wherein the first overlapping portion comprises a plurality of cantilevers, and the plurality of cantilevers are configured to be affixed on an inner wall or an outer wall of the second overlapping portion;

wherein the second overlapping portion comprises a plurality of docking sheets, the plurality of docking sheets are in one-to-one correspondence with the plurality of cantilevers, and a rib is disposed between every two adjacent docking sheets;

wherein each of the plurality of cantilevers is configured to be affixed on an outer wall of a respective one of the plurality of docking sheets, the rib is convexly disposed relative to the second half housing, and when each of the plurality of cantilevers is overlapped with and connected to the respective one of the plurality of docking sheets, an outer wall of each of the plurality of cantilevers is flush with an outer wall of the rib.

16. The metal housing according to claim 15, wherein the plurality of cantilevers are disposed at two ends on a docking side of the first half housing.

17. The metal housing according to claim 15, wherein one of the first overlapping portion or the second overlapping portion is provided with a hook, another of the first overlapping portion or the second overlapping portion is provided with an engaging hole, and the hook is hooked in the engaging hole when the first overlapping portion is overlapped with the second overlapping portion.

18. The metal housing according to claim 15, wherein the first half housing or the second half housing is further provided with a riveting claw.

* * * * *